US005151045A

United States Patent [19]

Cravens et al.

[11] Patent Number: 5,151,045

[45] Date of Patent: Sep. 29, 1992

[54] SEALS FOR AN ELECTRICAL CONNECTOR

[75] Inventors: David M. Cravens, Etters; Keith R. Denlinger, Lancaster; Richard W. Gryzbowski, Lebanon; John M. Myer, Millersville, all of Pa.

[73] Assignee: AMP Incorporated, Harrisburg, Pa.

[21] Appl. No.: 870,200

[22] Filed: Apr. 13, 1992

Related U.S. Application Data

[63] Continuation of Ser. No. 751,366, Aug. 28, 1991, abandoned.

[51] Int. Cl.[5] ..... H01R 13/432

[52] U.S. Cl. ..... 439/271

[58] Field of Search ..... 439/271-283

[56] References Cited

U.S. PATENT DOCUMENTS

| | | | |
|---|---|---|---|
| 4,684,190 | 8/1987 | Clark et al. | 439/587 |
| 4,842,540 | 6/1989 | Endo et al. | 439/271 |
| 4,917,620 | 4/1990 | Samejima et al. | 439/271 |
| 4,940,421 | 7/1990 | Kano et al. | 439/274 |
| 4,998,896 | 3/1991 | Lundergan | 439/595 |

*Primary Examiner*—Joseph H. McGlynn

*Attorney, Agent, or Firm*—Bruce J. Wolstoncroft; Allan B. Osborne

[57] ABSTRACT

Seals (20, 102) for an electrical connector (130) comprising a receptacle (10) and a pin header (122) has been disclosed. The first seal (20) includes grooves (50) in a body portion (30) which cooperate with ribs (b 52) on an end cap (22) to provide proper assembly orientation. A rim portion (106) on a second seal (102) includes an outwardly facing mating surface (114) for compression sealing and an inwardly facing surface (116) for peripheral sealing.

10 Claims, 5 Drawing Sheets

SEALS FOR AN ELECTRICAL CONNECTOR

This application is a continuation of application Ser. No. 07/751,366 filed Aug. 28, 1991, now abandoned.

FIELD OF THE INVENTION

The present invention relates to seals for electrical connectors such as are used in automobiles, trucks and tractors.

BACKGROUND OF THE INVENTION

Seals for electrical connectors are well known in the art; e.g., U.S. Pat. Nos. 4,973,268 and 4,998,896. It is now proposed to provide a seal for the receptacle half having an orientation feature and a seal for the header half having a combined peripheral and compression sealing.

SUMMARY OF THE INVENTION

According to the present invention, seals for an electrical connector are provided wherein one seal includes grooves in a body portion which cooperates with ribs on an end cap to ensure proper assembly in addition to the sealing function. A second seal includes a rim portion having an outwardly facing mating surface for compression sealing and an inwardly facing surface for peripheral sealing.

DESCRIPTION OF THE INVENTION

Figure 1:
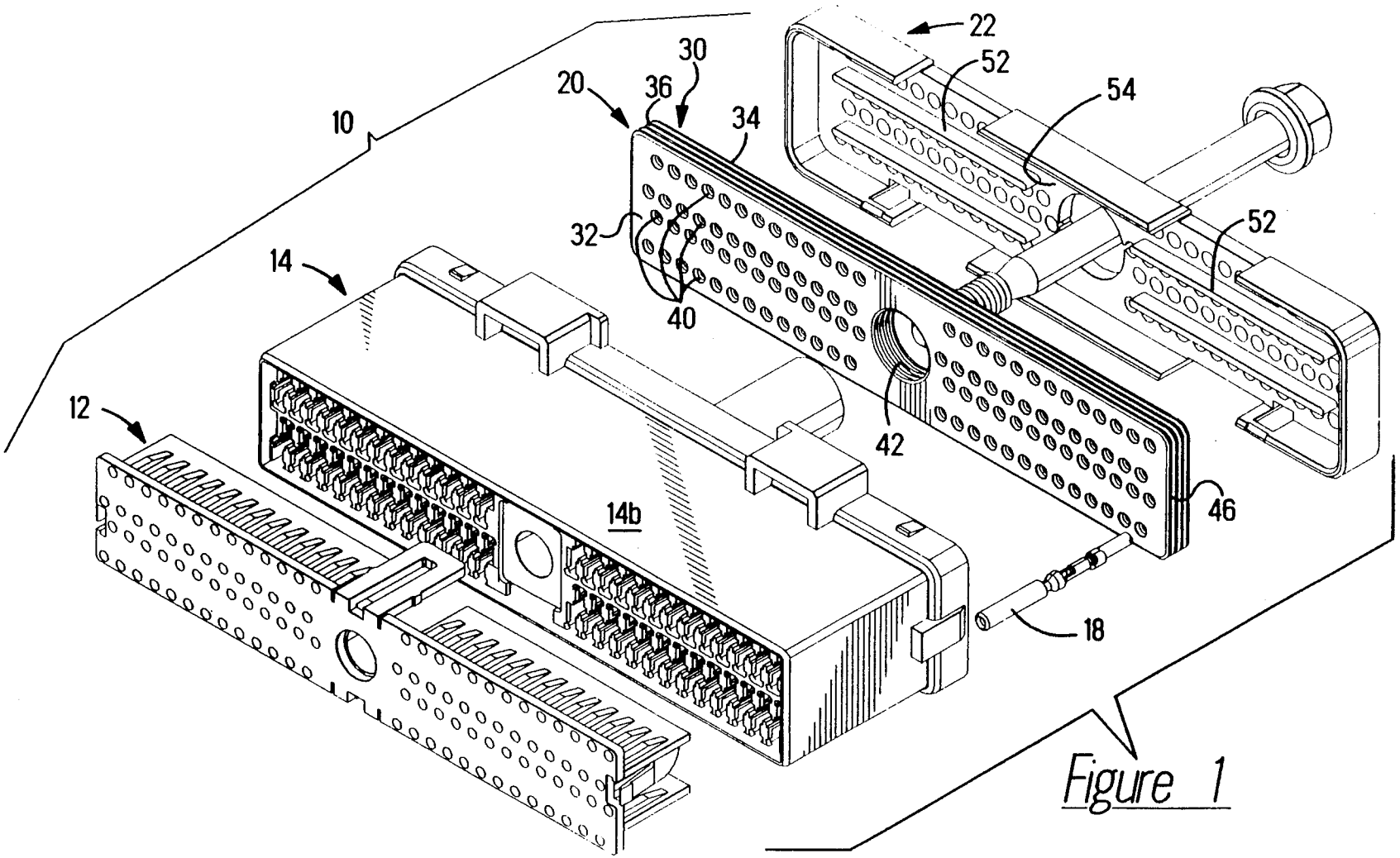
FIG. 1 is an exploded view of a receptacle of an electrical connector using a seal of the present invention.

With reference to FIG. 1, receptacle 10 includes terminal position assurance member 12, housing 14, socket terminals 18, rear seal 20 and rear face cap 22.

Figure 2:
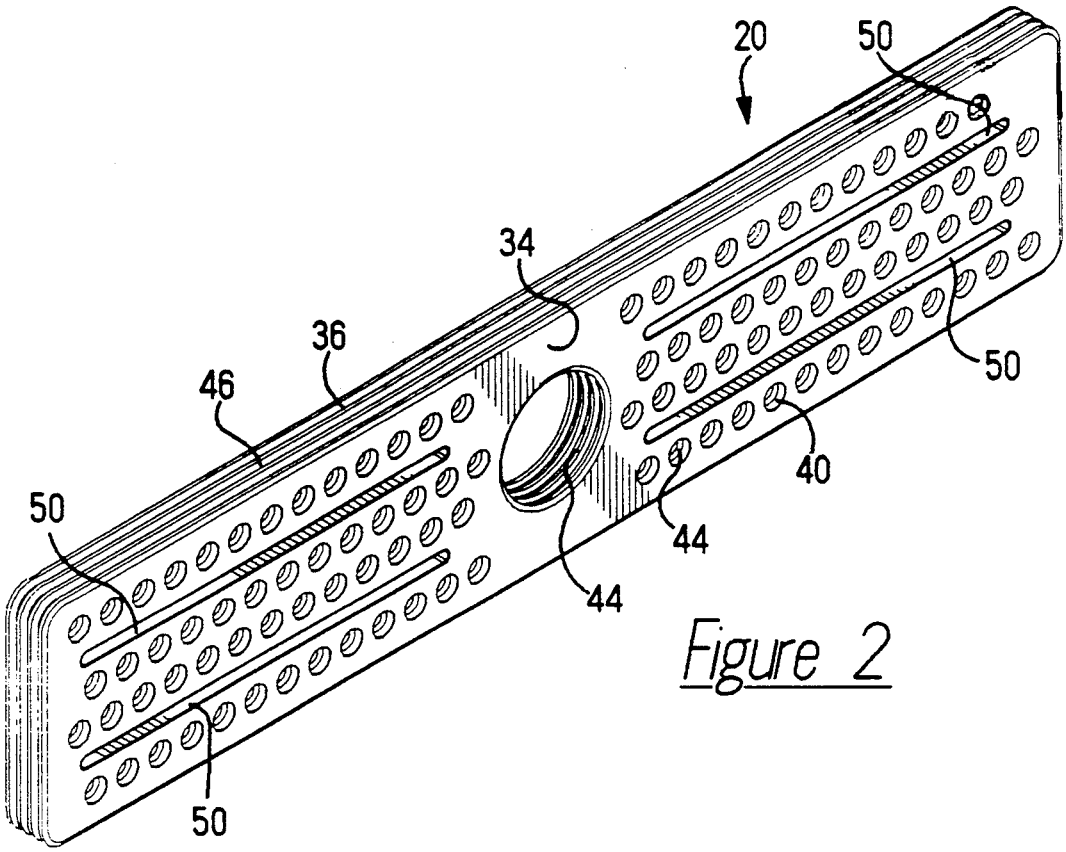
FIG. 2 is a view of the seal of the receptacle.

With reference to FIGS. 1 and 2, rear seal 20 includes a body portion 30 with front and rear surfaces 32,34 respectively and edge surface 36 therebetween.

Passages 40, on the same pattern as cavities in housing 14, extend through body portion 30 as does a centrally located large opening 42. The surfaces defining passages 40 and opening 42 are provided with inwardly projecting annular sealing ridges 44.

Outwardly projecting sealing ridges 46 are provided on edge surface 36.

As shown in FIG. 2, a set of four, longitudinally extending grooves 50 are provided in rear surface 34 of body portion 30. Grooves 50 are located between rows of passages 40 and on each side of opening 42.

Returning to FIG. 1, ribs 52 are provided on the inside surface 54 of rear face cap 22. These ribs 52 are on the same spacing as are grooves 50 on surface 34 of seal 20.

Grooves 50 and ribs 52 provide an orientation feature which prevents rear seal 20 from being assembled incorrectly. Besides providing a physical indicator, the grooves 50 provide a visual indicator.

Further, ribs 52 are slightly wider than grooves 50 so that upon assembly, the seal material of body portion 30 is compressed between the ribs 52 and side walls 56 of cap 22. Because of this compression, the thickness of body portion 30 is substantially less than what would otherwise be required for adequate sealing.

Figure 3:
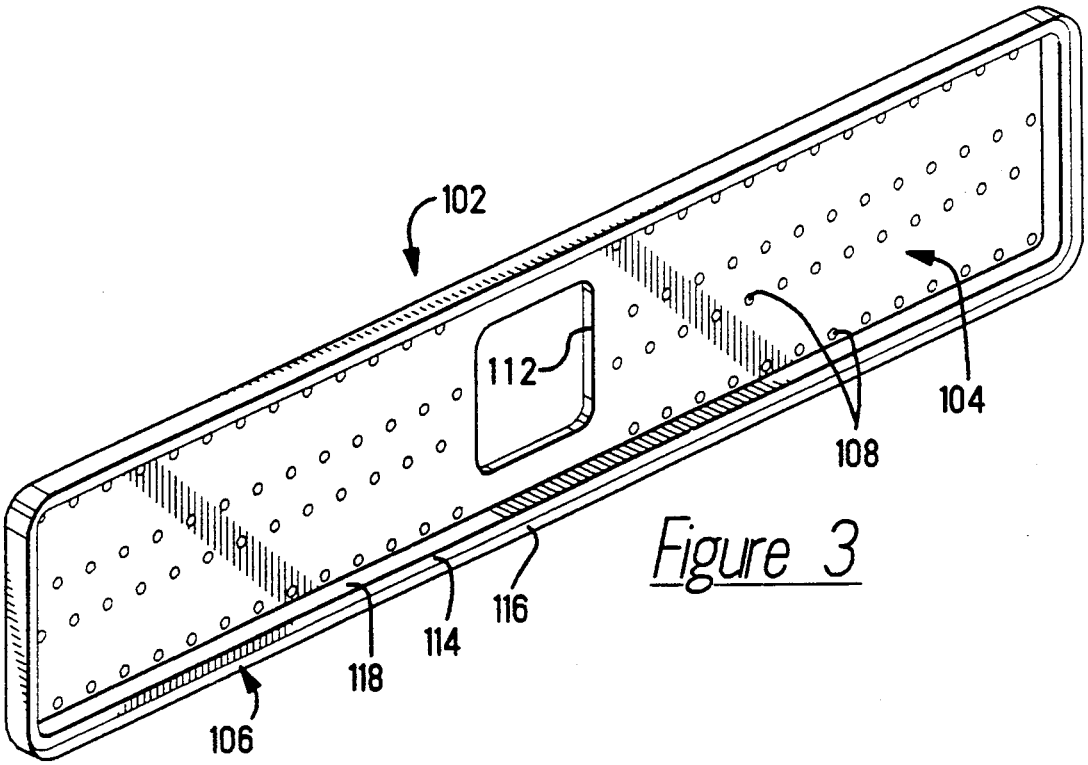
FIG. 3 is a view of a seal for pin header.
Figure 4:
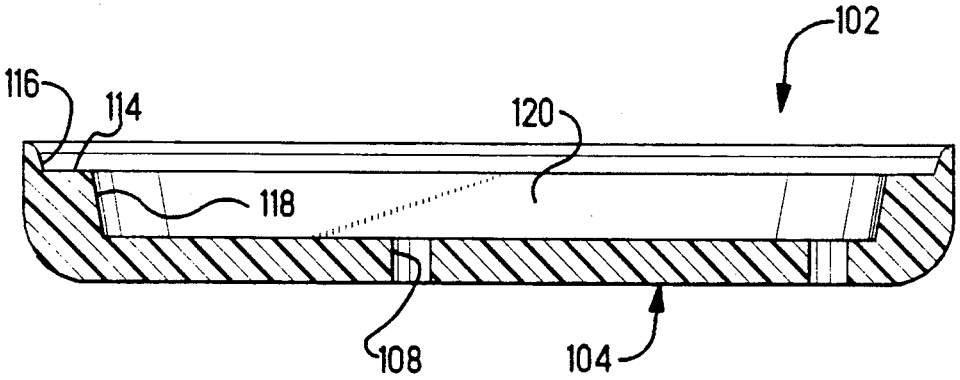
FIG. 4 is a sectioned view of the seal.
Figure 6:
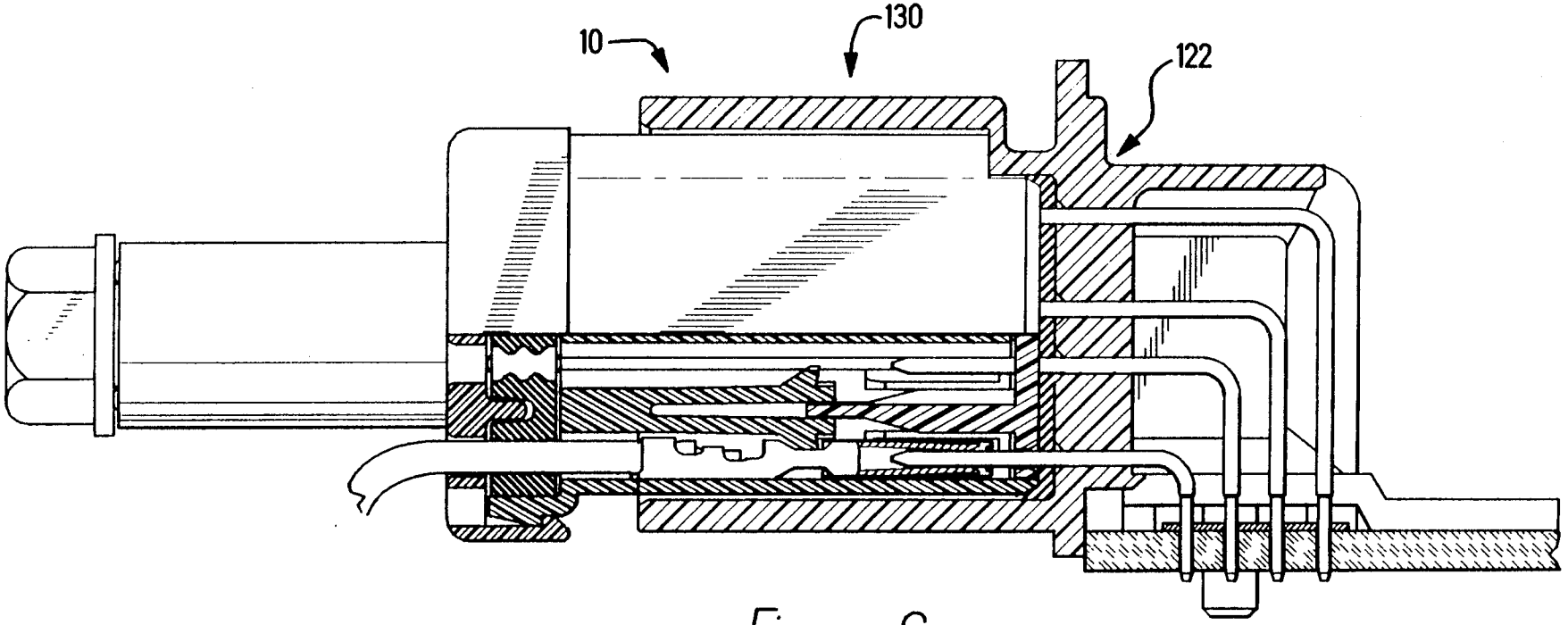
FIG. 6 shows the joined receptacle and sectioned header.

With reference to FIGS. 3 and 4, seal 102 includes body portion 104 and rim portion 106. Passages 108 in body portion provide access for pin terminals 110 (FIG. 6) and rectangular hole 112 provides access for a jackscrew 113 (FIG. 6).

Rim portion 106 includes an outwardly facing mating surface 114, a first inwardly facing surface 116 and a second inwardly facing surface 118.

Body portion 104 and rim portion 106 define space 120.

Seal 102 is preferably molded with a suitable material such as silicon rubber.

The geometry of rim portion 106 provides peripheral and compression sealing in the same space as a compression-only seal would occupy and less space than a traditional peripheral seal. Further, the seal geometry requires less force to compress seal 102.

Figure 5:
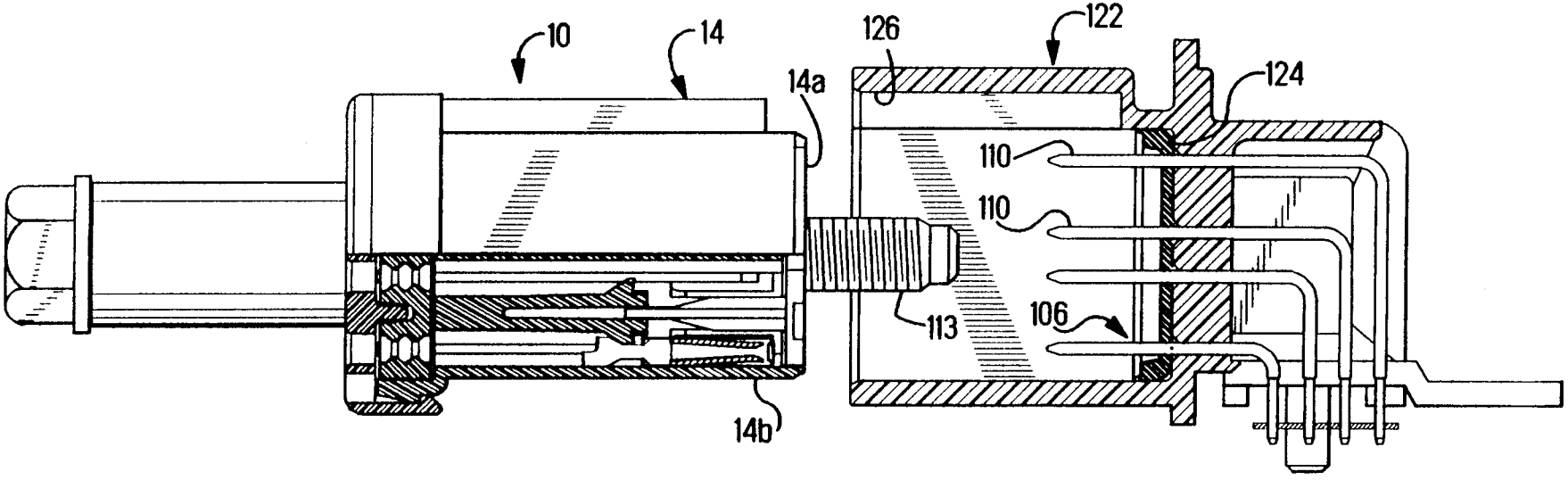
FIG. 5 shows the receptacle and sectioned header prior to being joined.

FIGS. 5 and 6 illustrate the use of seal 102 in pin header 122 for sealing the juncture with receptacle 10. Seal 102 is positioned on the base or floor 124 of cavity 126 of header 122 with terminals 110 extending through passages 108 (FIG. 4).

As receptacle 10 and header 122 are joined to provide electrical connector 130, edge 14*b* of housing 14 slides along first inwardly facing surface 116 and edge 14*a* of housing 14 engages mating surface 114. As receptacle 10 and header 122 are tightened up, the seal material beneath surface 114 is displaced such that the second inwardly facing surface 118 bulges out into space 120 (not shown). Displacing the material requires less force to compress a compression-type seal and solves a problem that was discovered during the testing of connector 30 with a prior art seal, i.e., that in a high temperature environment, the seal material expanded and induced internal stresses in plastic components 10,122 with the result that shrinkage occurred and the components 10,122 drew apart, creating leaks pass the seal. The displacement reduces the compression forces imposed on seal 102 and accordingly less internal stressing is induced into the receptacle 10 and header 122.

Peripheral sealing is obtained between side 14*b* of housing 14 and the first inwardly facing surface 116.

As can be discerned from the foregoing description, seals for an electrical connector has been disclosed. One seal includes an orientation feature which, in cooperation with an end cap, prevents incorrect assembly. Another seal provides a combination peripheral and compression sealing which reduces internal stresses which can occur in the plastic components and thereby insures continual sealing during elevated temperature exposures.

We claim:

1. Seals for use in an electrical connector comprising a receptacle and a pin header, said seals comprising:

a first seal for use in a rear end of a receptacle in conjunction with an end cap having arranged, inwardly projecting ribs, said first seal having a body portion with grooves therein arranged to receive said ribs when said end cap is oriented in a predetermined position; and a second seal having a body portion and a rim portion extending normally outwardly from edges of said body portion, said rim portion having first and second inwardly facing surfaces and a outwardly facing mating surface, said second seal adapted for use in a cavity in a pin header with said mating surface adapted to be compressingly received by an edge of a receptacle inserted into said cavity whereupon said second surface bulges out into a space defined by said body and rim portions.

2. The seals of claim 1 wherein said first inwardly facing surface on said rim portion of said second seal slidingly engages sides of said receptacle for peripheral sealing therebetween.

3. The seals of claim 1 wherein edges of said first seal are provided with outwardly projecting ridges and passages through a body portion are provided with inwardly projecting ridges.

4. The seals of claim 1 wherein said ribs are frictionally received in said grooves whereby said seal is compressed between said ribs and walls of said end cap.

5. An electrical connector comprising a housing having at least one rib provided thereon, a seal member positioned in the housing, the seal member having at least one groove which extends from a first surface of the seal member toward a second surface, the rib is dimensioned to be wider than the groove such that the rib will cause the seal member to be compressed between the ribs and the housing.

6. An electrical connector as recited in claim 5 wherein the at least oen groove is located between rows of passages.

7. An electrical connector as recited in claim 6 wherein the housing has a cap, the at least one is positioned on an inside surface of the cap.

8. An electrical connector as recited in claim 7 wherein the at least one rib and the at least one groove provided on orientation feature which prevents the seal member from being assembled incorrectly.

9. An electric connector comprising:

a housing with a cavity for receipt of a mating connector therein, terminals extend through the housing into the cavity;

a seal having a body portion and a rim portion extending normally outwardly from edges of said body portion, said rim portion having first and second inwardly facing surfaces and an outwardly facing mating surface, said seal adapted for use in the cavity with said mating surface adapted to be compressingly received by an edge of the mating connector inserted into the cavity whereupon said second surface bulges out into a space defined by said body and rim portions.

10. An electrical connector as recited in claim 9 wherein first inwardly facing surface on said rim portion of the seal slidingly engages sides of the mating connector for peripheral sealing therebetween.

* * * * *